US010438458B2

(12) United States Patent
Keikhosravy et al.

(10) Patent No.: US 10,438,458 B2
(45) Date of Patent: Oct. 8, 2019

(54) APPARATUS AND METHOD FOR DETECTION AND NOTIFICATION OF ACOUSTIC WARNING SIGNALS

(71) Applicants: PICOTERA ELECTRONICS INC., Vancouver (CA); Kamyar Keikhosravy, Vancouver (CA)

(72) Inventors: Kamyar Keikhosravy, Vancouver (CA); Jing Zhang, Vancouver (CA); Pouya Kamalinejad, Vancouver (CA)

(73) Assignees: Kamyar Keikhosravy, Vancouver (CA); PICOTERA ELECTRONICS INC., Vancouver (CA)

( * ) Notice: Subject to any disclaimer, the term of this patent is extended or adjusted under 35 U.S.C. 154(b) by 0 days.

(21) Appl. No.: 15/214,450

(22) Filed: Jul. 20, 2016

(65) Prior Publication Data

US 2017/0024990 A1 Jan. 26, 2017

Related U.S. Application Data

(60) Provisional application No. 62/194,789, filed on Jul. 20, 2015.

(51) Int. Cl.
*G08B 1/08* (2006.01)

(52) U.S. Cl.
CPC ..... *G08B 1/08* (2013.01)

(58) Field of Classification Search
CPC ..... G08B 1/08
See application file for complete search history.

(56) References Cited

U.S. PATENT DOCUMENTS 3,992,656 A 11/1976 Joy
4,625,206 A * 11/1986 Jensen ..... G08G 1/087 340/901
5,252,964 A * 10/1993 Tan ..... G08B 3/1066 340/7.4
5,710,555 A 1/1998 McConnell et al.
7,791,499 B2 9/2010 Mohan et al.
8,068,025 B2 11/2011 Devenyi et al.
(Continued)

*Primary Examiner* — James J Yang
(74) *Attorney, Agent, or Firm* — Smiths IP; Lawrence Chan

(57) ABSTRACT

The present invention provides for a portable apparatus and method for detection of environmental warning signals. The apparatus having an acoustic input device configured to produce an electrical representation of detected environmental warning signals, an electronic pre-processing unit configured to determine if the electrical representation satisfies a primary set of criteria, an electronic post-processing unit configured to verify if the electrical representation satisfies a secondary set of criteria and a warning indicator configured to transmit an alarm notification. The method having the steps of detecting an environmental warning signals, producing an electrical representation of the detected environmental warning signals, pre-processing the electrical representation to determine if a primary set of criteria has been met, if the set of criteria has been met, post processing the detected electrical signal to determine if a secondary set of criteria has been met and producing an alert message through at least one of an audible indicator, vibration indicator, visual indicator or wireless signal transmitter.

13 Claims, 2 Drawing Sheets

(56) References Cited

U.S. PATENT DOCUMENTS

| | | | | |
|---|---|---|---|---|
| 8,094,040 | B1 | 1/2012 | Cornett et al. | |
| 2003/0048449 | A1* | 3/2003 | Vander Jagt | G01J 3/10 356/432 |
| 2004/0145465 | A1* | 7/2004 | Stults | G08B 1/08 340/521 |
| 2004/0233067 | A1 | 11/2004 | Cho | |
| 2006/0177071 | A1* | 8/2006 | Eskildsen | G08B 13/1672 381/56 |
| 2007/0189544 | A1 | 8/2007 | Rosenberg | |
| 2011/0043328 | A1* | 2/2011 | Bassali | G07C 9/00182 340/5.71 |
| 2016/0117905 | A1* | 4/2016 | Powley | G08B 21/18 340/521 |
| 2016/0269841 | A1* | 9/2016 | Shinde | G08B 1/08 |

* cited by examiner

APPARATUS AND METHOD FOR DETECTION AND NOTIFICATION OF ACOUSTIC WARNING SIGNALS

REFERENCE TO PENDING APPLICATIONS

This application claims the benefit of pending U.S. Patent Application Ser. No. 62/194,789 filed on Jul. 20, 2015 and entitled METHOD AND APPARATUS FOR DETECTION AND NOTIFICATION OF ACOUSTIC WARNING SIGNALS.

REFERENCE TO MICROFICHE APPENDIX

This application is not referenced in any microfiche appendix.

BACKGROUND OF THE INVENTION

Field of the Invention

The present invention is generally related to the field of electronic acoustic devices and more specifically, toward an apparatus and related method for the detection and notification of acoustic and/or visual environmental warning signals.

Background

Rapid development in noise cancellation and soundproofing techniques has promoted an increase use of headphones, earphones and headsets with noise cancellation capabilities. Due to these devices having the ability to reduce the level of districting ambient, background noise, these types of headphone and headsets have become especially popular with people listening to music, such as runners or cyclists, as well as construction workers, factory workers, and airport/airplane workers and passengers. These devices, however, have an inherit disadvantage, namely, the user is subjected to a considerable reduction of awareness towards acoustic warning signals, such as fire and police sirens and warning alarms, in conjunction with airports/airplanes and construction sites. This disadvantage can cause an increase in the possibility of life threatening accidents.

In the prior art, there have been attempts to detect warning sounds such as sirens. One example may include an electronic system with a plurality of electronic active filters and a controlling logic for reliably detecting siren sounds in the noisy street environment. Another example may include a siren detector system with a transducer, pre-amplifier, analog-to-digital converter, limiter-discriminator, plurality of selection filters and a preempt detection logic which produces a preempt output signal for traffic light control systems if the input signal meets the selection criteria in terms of sound level and frequency. Another example may include a method and apparatus for detecting siren sounds in order to control traffic lights at intersections or to warn drivers of an approaching emergency vehicle. Another method may include a personal alerting device that can detect a predetermined pattern of sounds and send an alert signal to an output device.

However these examples of acoustic warning devices are disadvantageous because they have complex components with high power and processing requirements and only detect "warning" sounds but do not notify a user of the warning after detection. The prevalence of portable music players accompanied with high quality noise cancellation headphones requires a simple simpler warning detection system.

Thus, there is a need for an improved warning device and method.

BRIEF SUMMARY OF THE INVENTION

The present invention satisfies the needs discussed above. The present invention is generally related to the field of electronic environmental warning devices and more specifically, toward an apparatus and related method for the detection and notification of acoustic and/or visual warning signals.

One aspect of the present invention is directed toward an apparatus for the detection of acoustic and/or visual warning signals (e.g. police and ambulance sirens, car and truck's honks, loud noises, designated words, honking, announcement, announcement tone, or any other loud sounds or predefined pattern of sound), and/or visual warning signals (e.g. strobe lights) and performance of a notification action to raise the awareness of the impaired hearing individuals. The notification action may be an audible, visual, vibration or any other configurable alarm, such as the device making a loud beep sound or streaming the amplified surrounding sounds. This device may be portable and/or battery powered. In an embodiment, the apparatus detects incoming warning sounds (such as alarms) or any sounds of interest and notifies the user. One example of such notification method includes, but is not limited to, disabling the noise blocking mechanism in a device (i.e. headphones, earphones, headsets with noise cancellation capabilities). In an embodiment, where the device completely blocks environmental sounds, the notification method may completely disable the device's sound blocking feature and perform a notification action to the device's user.

In this aspect, a user may schedule the operation of the warning detector system through a software program that may be installed on a portable music player device. Through this software program, the user can also receive information regarding the current status of this apparatus. This allows this aspect to be capable of operating in a self-sufficient manner, without draining power from or using the processing resources of a secondary device such as a music player.

An additional aspect of the apparatus of the present invention allow the apparatus to be used as a standalone wearable device, embedded in or plugged into a fitness tracking device, such as a FITBIT™ device, or any other sort of wearable electronics, or integrated with the car audio system, to detect and notify the users of the surrounding audio warning signals. Still yet, an additional aspect of the apparatus of the present invention allows the apparatus to be in direct communication with the headphones through a wired communication. This aspect allows for a simpler architecture by not requiring various components such as for wireless communication, power management, battery or battery charger blocks.

In another aspect of the apparatus of the present invention includes an input device configured to produce an electrical representation of detected environmental warning signals (e.g. an acoustic or visual warning signal), an electronic pre-processing unit configured to determine if the electrical representation satisfies a primary set of criteria, an electronic post-processing unit configured to verify if the electrical representation satisfies a secondary set of criteria, and a warning indicator configured to transmit an alarm notification.

In this aspect, the input device may be an acoustic input device, such as a microphone, or a visual input device. Further, the electronic pre-processing unit has at least one amplifier, at least one programmable gain amplifier, at least one band-pass filter and at least one AC-to-DC converter. The electronic post-processing unit includes a central processing unit. The primary set of criteria is selected from the group consisting of frequency content, signal level, and a combination of thereof. While, the secondary set of criteria is selected from the group consisting of frequency content, signal level, pattern of signal and a combination of thereof. The warning indicator includes at least one of a speaker to produce audible alarm, a light emitting diode to produce visual alarm, a vibrator to produce vibration alarm and a wireless signal transmitter to transmit the alarm message to a remote device.

Another aspect of the present invention is directed toward a method for detection and notification of environmental warning signals. This aspect includes detecting an environmental warning signal, producing an electrical representation of the detected environmental warning signal, preprocessing the electrical representation to determine if a primary set of criteria has been met, if the set of criteria has been met, post processing the detected electrical signal to determine if a secondary set of criteria has been met and producing a notification indicator. The environmental warning signal may be an acoustic or visual warning signal. The notification indicator may at least one of an audible indicator, vibration indicator, visual indicator, or wireless signal transmitter, or a combination thereof. The step of producing a notification indicator may also include turning off acoustic signal blockage, producing a haptic feedback indicator, and/or streaming sounds from outside into the portable apparatus. In this method, the primary set of criteria may be selected from the group consisting of frequency content, signal level, and a combination of thereof and the secondary set of criteria may be selected from the group consisting of frequency content, signal level, pattern of signal and a combination of thereof.

It is to be understood that the invention is not limited in its application to the details of the construction and arrangement of parts illustrated in the accompanying drawings. The invention is capable of other embodiments and of being practiced or carried out in a variety of ways. It is to be understood that the phraseology and terminology employed herein are for the purpose of description and not of limitation.

Upon reading the above description, various alternative embodiments will become obvious to those skilled in the art. These embodiments are to be considered within the scope and spirit of the subject invention, which is only to be limited by the claims which follow and their equivalents.

DESCRIPTION OF THE INVENTION

The present invention satisfies the needs discussed above. The present invention is generally related to the field of electronic warning devices and more specifically, toward an apparatus and related method for the detection and notification of acoustic and/or visual warning signals.

Figure 1:
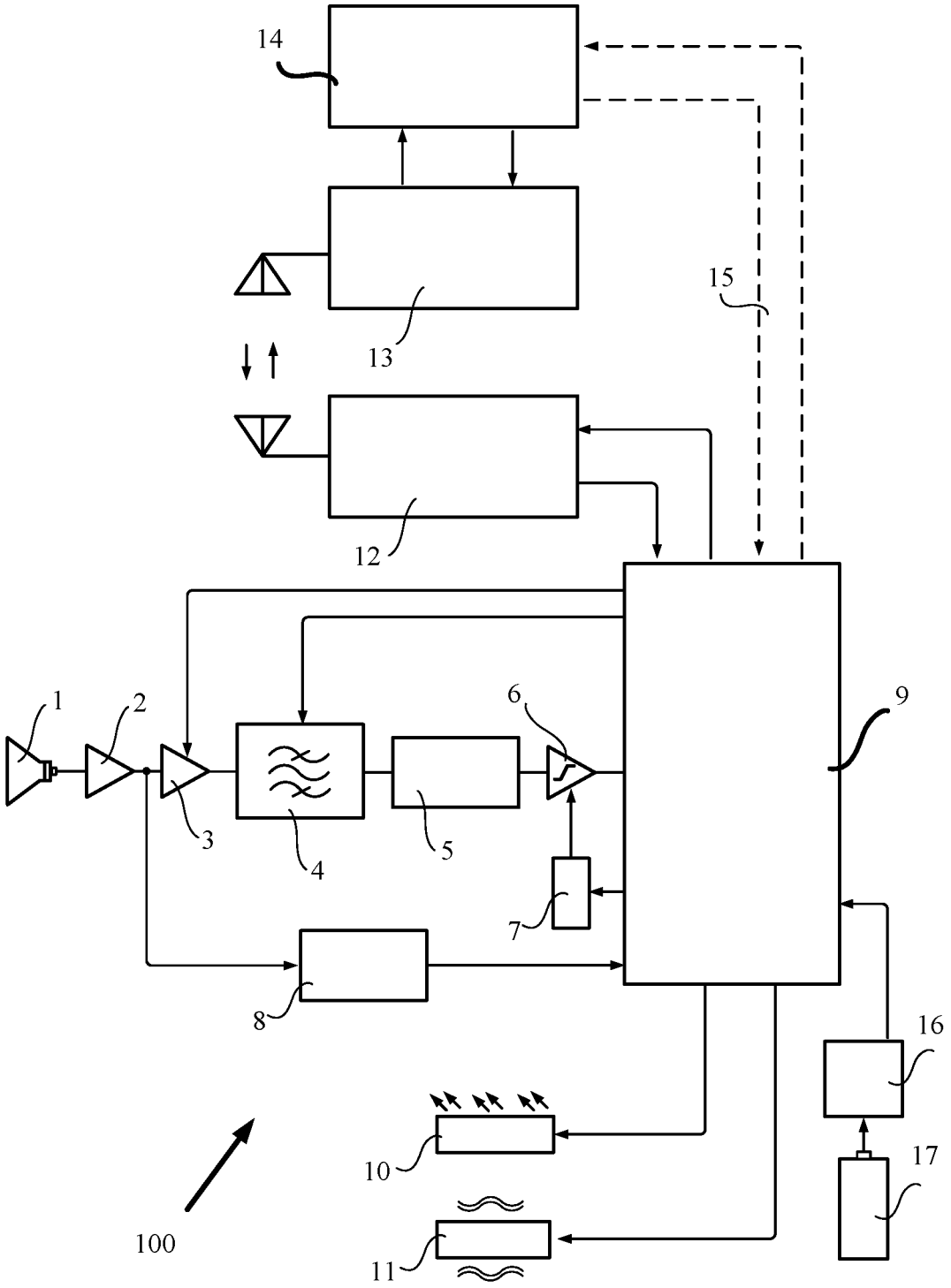
FIG. 1 is a block diagram of an embodiment of the present inventive apparatus.

FIG. 1 is a block diagram that illustrates an embodiment 100 of the apparatus of the present invention. This embodiment is shown being associate with a user device 14. The user device may be a music player; however, this is only illustrative. Those skilled in the art will recognize the present invention may be utilized with other devices.

In general, embodiment 100 is an energy-efficient, battery powered, portable device that comprises an acoustic input device 1, a pre-processing unit having a chain of amplifiers 2,3, a filter 4, a AC-to-DC converter 5, a post-processing unit having central processing unit 9, along with a comparator 6, reference generator 7, a battery 17 and power management unit 16, an analog-to-digital converter 8, visual indicators 10, a vibration indicator 11, wired 15 or wireless communication modules 12,13, and a user device 14.

Acoustic input device 1 may be a microphone that receives and converts the ambient sound signals into electrical signals. Primary amplifier 2 amplifies these electrical signals. A secondary programmable gain amplifier 3 may be used to further amplify the electrical signal, and which is controlled by the central processing unit 9. The programmable gain of the secondary amplifier 3 allows for users to configure the sensitivity of the warning detection component of this embodiment 100. A band-pass filter 4 attenuates the portion of the amplified signal which lies outside the frequency range of interest. The specific frequency range of passband filter 4 may be predefined for certain types of warning signals. The passband frequency range can also be set by the central processing unit 9 to allow detection of different acoustic warning signals or sound patterns. AC-to-DC converter block 5 produces a DC voltage representation of the filtered signal. This DC voltage is then compared to a reference level generated by reference voltage generator block 7 through comparator 6. The reference voltage may be set by the user through the central processing unit 9 to establish the sensitivity of the warning detection system. If all the conditions in terms of frequency content and signal level are met by the input signal, the comparator 6 triggers an interrupt circuit, which activates the central processing unit 9 by sending an interrupt signal to the central processing unit 9. The interrupt circuit may be analog in nature in order to minimize power consumption.

Once interrupted, the central processing unit 9 which normally may be in a low-power sleep mode, activates and starts to process the input signal. Central processing unit 9 can use as an input the signal from the output of any of the blocks along the chain, after the input device 1 and before the AC-to-DC converter 5 and the output of analog-to-digital converter 8.

Central processing unit 9 conducts a secondary examination on the input signal to determine if a secondary set of criteria have been established. These secondary set of criterial include a verification of the frequency content and signal level as well as a determination of the pattern of the signal in time, and may be either predefined or customized by the user. The verification method may include performing a matching algorithm between the input signal and a predefined pattern. If the results of the secondary examination meet the secondary set of criteria, the central processing unit 9 concludes that a positive detection of a warning signal exists and transmits a warning message to activate any or all of the visual indicators 10, audio indicators through the user device 14, vibration indicators 11 and to user 14 through electrical wires 15 or by means of the wireless communication module 12,13.

This power for this embodiment 100 may be supplied either by means of rechargeable or disposable battery 17 and power management system 16 or through a wire connection 15 from user device 14.

Various configurations of the apparatus of the present invention may be maintained. In an embodiment of the apparatus of the present invention, the apparatus is a self-sufficient and energy-efficient portable device, which uses its embedded battery and dedicated processor and notifies the user through the mounted visual or vibration notification or through a wireless communication with the music player device. In another embodiment, the apparatus is configured to be equipped with or added to wearable electronic devices, such as fitness tracking devices, and use the resources of the host device for part or all of its energy, post-processing and communication requirements. In another embodiment, the apparatus is configured to be directly wired to a noise cancellation headphone or car audio system and communicate with the user through a wired communication connection.

The attributes of the apparatus of the present invention may be customized by user through a native software program on the music player device. Further, it may be configured to allow for the adjustment in the volume level or control the music or stream the surrounding sounds through a wireless communication between the proposed system and the music player.

Figure 2:
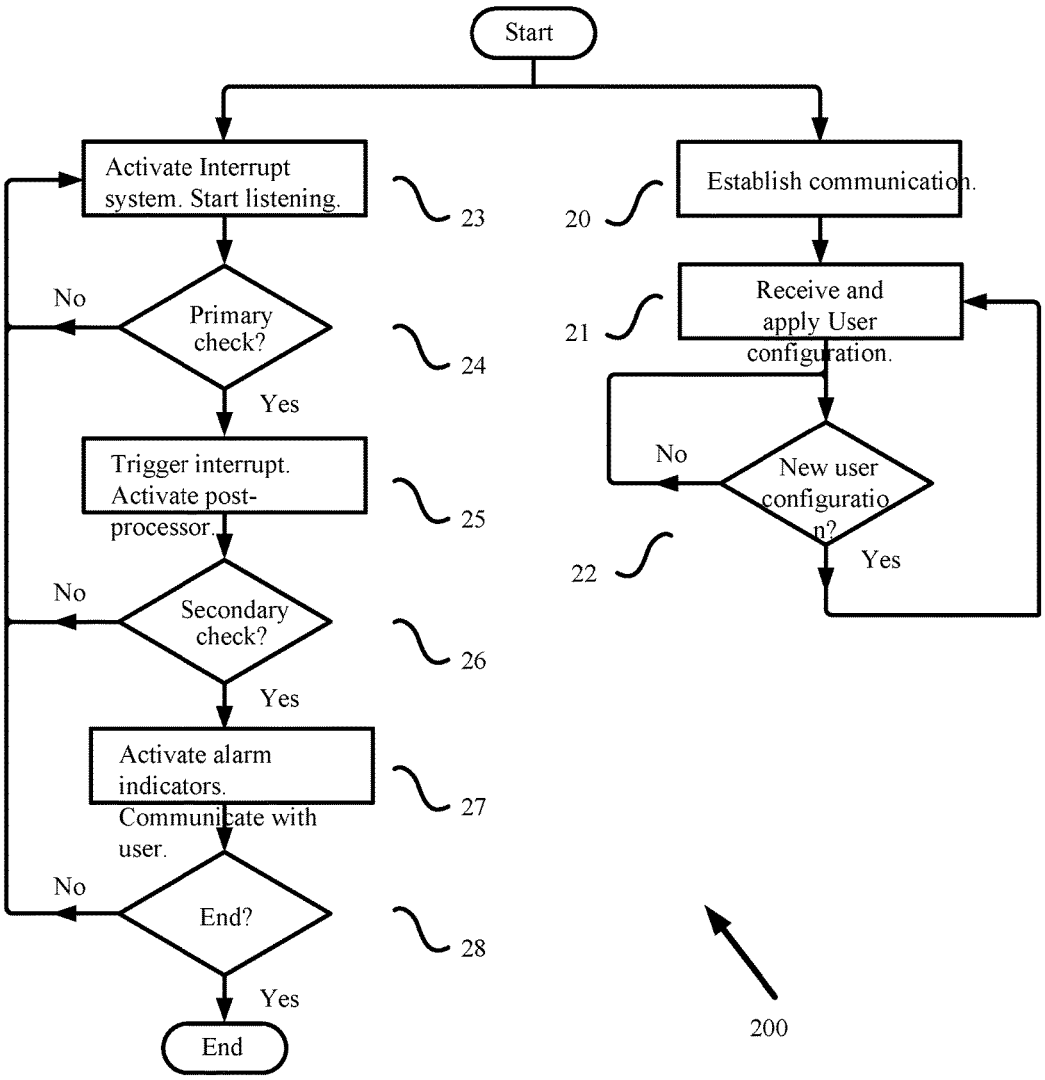
FIG. 2 is a processing flow chart of an embodiment of the present inventive method.

FIG. 2 is a flow diagram that illustrates an embodiment 200 of the method of the present invention. At the start of the process, which may be when the embodiment 100 is switched on, embodiment 100 establishes communication 20 with the user device 14 and receives user configuration through the software application 21. The user can configure whether the system should be in active mode and also may set up an activity schedule for the system. The system constantly monitors the user commands and applies new user configurations 22. If the system is configured to be inactive, it will go to sleep/low-power mode in which case it waits for the next user command or the pre-scheduled activation/de-activation time. If the system is configured to be active, the interrupt system is activated and the detector starts to listen and pre-process the incoming signals 23.

The pre-processed signal is constantly checked against the primary criteria 24. If the primary criteria for being a warning signal are not met, the signal will be discarded and the system continues to listen and pre-process the subsequent signals 23. If the signal meets the primary criteria, an interrupt signal is generated which activates the post-processor 25.

The post-processed signal is checked against the secondary criteria 26. If the secondary criteria for being a warning signal are not met, the signal will be discarded and the system continues to listen and pre-process the subsequent signals 23. If the post-processed signal satisfies the secondary criteria for being a warning signal, the system activates alarm indicators and notifies the user of the detected warning signal 27.

Upon completion of detection, the system checks the configuration to determine whether or not to keep monitoring incoming signals 28. If it is set to continue, the interrupt maintains active and the same process continues until the next user configuration or the pre-scheduled activation/de-activation time arrives.

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification.

The invention claimed is:

1. A portable apparatus for use with a portable wearable device and for detection of environmental warning signals by a hearing-impaired person, the apparatus comprising:

an input device configured to convert detected environmental warning signals into electrical signals;

a pre-processing unit configured to process the electrical signals, the pre-processing unit comprising;

one or more programmable amplifiers configured to generate amplified electrical signals based on the electrical signals, wherein the amplifiers are adjustable to change a level of sensitivity for detection;

one or more programmable band-pass filters configured to attenuate a portion of the amplified electrical signals to generate attenuated electrical signals, wherein the portion of the amplified electrical signals that is attenuated lies outside a frequency range of interest;

a AC-to-DC converter block configured to produce a DC voltage representation based on the attenuated electrical signals; and a comparator configured to compare the DC voltage representation with a reference voltage;

wherein the pre-processing unit transmits an interrupt signal if the electrical signals satisfy a primary set of criteria, based at least in part on a comparison of the DC voltage representation with the reference voltage;

wherein the primary set of criteria comprises both frequency content and signal level; and wherein the frequency content comprises frequency content corresponding to the environmental warning signals;

a post-processing unit configured to operate in a low-power sleep mode until receipt of the interrupt signal transmitted from the pre-processing unit, at which time the interrupt signal enables the post-processing unit to verify if the electrical signals satisfy a secondary set of criteria; and a warning module configured to generate a warning notification upon verification that the electrical signals satisfy the secondary set of criteria;

a vibrator module configured to produce vibration alert upon generation of the warning notification; and a communications module configured to transmit the warning notification to the portable wearable device;

wherein the portable apparatus is located proximate to the portable wearable device;

wherein the warning notification is configured to cause the portable wearable device to generate a warning to the hearing-impaired person; and wherein the reference voltage is adjustable by the hearing-impaired person or the post-processing unit to change the level of sensitivity.

2. The apparatus of claim 1, wherein the input device comprises an acoustic device.

3. The apparatus of claim 1, wherein the input device comprises a microphone.

4. The apparatus of claim 1, wherein the pre-processing unit comprises at least three filters.

5. The apparatus of claim 1, wherein the post-processing unit comprises a central processing unit.

6. The apparatus of claim 1, wherein the secondary set of criteria comprises one or more of frequency content, signal level, or pattern of signal.

7. The apparatus of claim 1, wherein the warning notification causes one or more of the following additional effects for the portable wearable device: an audible alarm, a visual alarm, and the portable wearable device disabling any acoustic signal blockage.

8. A method for detection and notification of environmental warning signals in a portable apparatus of a hearing-impaired person, the method comprising the steps of:

detecting environmental warning signals;

converting the environmental warning signals into electrical signals;

generating by one or more programmable amplifiers amplified electrical signals based on the electrical signals, wherein the amplifiers are adjustable to change a level of sensitivity for detection;

attenuating by one or more programmable band-pass filters a portion of the amplified electrical signals to generate attenuated electrical signals, wherein the portion of the amplified electrical signals that is attenuated lies outside a frequency range of interest;

producing a DC voltage representation based on the attenuated electrical signals;

comparing the DC voltage representation with a reference voltage;

transmitting an interrupt signal if a primary set of criteria has been met, based at least in part on a comparison of the DC voltage representation with the reference voltage, wherein the primary set of criteria comprises both frequency content and signal level and wherein the frequency content comprises frequency content corresponding to the environmental warning signals;

receiving by a post-processing unit the interrupt signal transmitted from the pre-processing unit, wherein the post-processing unit is normally in a low-power sleep mode;

exiting the low-power sleep mode by the post-processing unit upon receipt of the interrupt signal transmitted from the pre-processing unit;

enabling the post-processing unit to verify the electrical signals to determine if a secondary set of criteria has been met;

generating a warning notification upon verification that the electrical signals satisfy the secondary set of criteria, the warning notification causing a vibrator module to produce vibration alert; and transmitting the warning notification to a portable wearable device located proximate to the portable apparatus wherein the warning notification is configured to cause the portable wearable device to generate a warning to the hearing-impaired person; and wherein the reference voltage is adjustable by the hearing-impaired person or the post-processing unit to change the level of sensitivity.

9. The method of claim 8, wherein the environmental warning signals comprise an acoustic warning signal.

10. The method of claim 8, wherein the step of producing a warning notification comprises at least one of the steps of turning off acoustic signal blockage or streaming sounds from outside into the portable apparatus.

11. The method of claim 8, wherein the secondary set of criteria comprises one or more of frequency content, signal level, or pattern of signal.

12. A system for detecting environmental warning signals by a hearing-impaired person, the system comprising:

a portable wearable device configured to be worn by the hearing-impaired person; and a portable detection apparatus located proximate to the portable wearable device and worn by the hearing-impaired person, the portable detection apparatus comprising:

an input device configured to convert detected environmental warning signals into electrical signals;

a pre-processing unit configured to process the electrical signals, the pre-processing unit comprising:

one or more programmable amplifiers configured to generate amplified electrical signals based on the electrical signals, wherein the amplifiers are adjustable to change a level of sensitivity for detection;

one or more programmable band-pass filters configured to attenuate a portion of the amplified electrical signals to generate attenuated electrical signals, wherein the portion of the amplified electrical signals that is attenuated lies outside a frequency range of interest;

a AC-to-DC converter block configured to produce a DC voltage representation based on the attenuated electrical signals; and a comparator configured to compare the DC voltage representation with a reference voltage;

wherein the pre-processing unit transmits an interrupt signal if the electrical signals satisfy a primary set of criteria, based at least in part on a comparison of the DC voltage representation with the reference voltage;

wherein the primary set of criteria comprises both frequency content and signal level; and wherein the frequency content comprises frequency content corresponding to the environmental warning signals;

a post-processing unit configured to operate in a low-power sleep mode until receipt of the interrupt signal transmitted from the pre-processing unit, at which time the interrupt signal enables the post-processing unit to verify if the electrical signals satisfy a secondary set of criteria; and a warning module configured to generate a warning notification upon verification that the electrical signals satisfy the secondary set of criteria;

a vibrator module configured to produce vibration alert upon generation of the warning notification and a communications module configured to transmit the warning notification to the portable wearable device;

wherein the warning notification is configured to cause the portable wearable device to generate a warning to the hearing-impaired person; and wherein the reference voltage is adjustable by either the hearing-impaired person or the post-processing unit to change the level of sensitivity.

13. The system of claim 12, wherein the warning comprises one or more of the following effects for the portable wearable device: an audible alarm, a visual alarm, and the portable wearable device disabling any acoustic signal blockage.

* * * * *